US007132042B2

(12) United States Patent
Genetti et al.

(10) Patent No.: US 7,132,042 B2
(45) Date of Patent: Nov. 7, 2006

(54) PRODUCTION OF FUELS AND LUBE OILS FROM FISCHER-TROPSCH WAX

(75) Inventors: William Berlin Genetti, Baton Rouge, LA (US); Adeana Richelle Bishop, Baton Rouge, LA (US); Nancy Marie Page, Baton Rouge, LA (US); Gregg Johnston Howsmon, Baton Rouge, LA (US); Loren Leon Ansell, Baton Rouge, LA (US); Jack Wayne Johnson, Clinton, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 666 days.

(21) Appl. No.: 10/266,368

(22) Filed: Oct. 8, 2002

(65) Prior Publication Data

US 2004/0065588 A1 Apr. 8, 2004

(51) Int. Cl.
*C10G 47/02* (2006.01)
*C10G 35/04* (2006.01)
*C07C 5/13* (2006.01)

(52) U.S. Cl. ..... 208/28; 208/30; 208/111.35; 208/134; 208/137; 585/734; 585/752; 585/736

(58) Field of Classification Search ..... 208/28, 208/30, 111.35, 134, 137; 585/734, 752
See application file for complete search history.

(56) References Cited

U.S. PATENT DOCUMENTS

| | | | | |
|---|---|---|---|---|
| 2,250,410 | A | 7/1941 | van Peski | 260/676 |
| 3,711,399 | A | 1/1973 | Estes et al. | 208/112 |
| 4,097,364 | A | 6/1978 | Egan | 208/111 |
| 4,181,597 | A | 1/1980 | Yan et al. | 208/46 |
| 4,335,019 | A | 6/1982 | Bowes et al. | 252/450 |
| 4,377,469 | A | 3/1983 | Shihabi | 208/111 |
| 4,388,177 | A | 6/1983 | Bowes et al. | 208/111 |
| 4,402,866 | A | 9/1983 | Shihabi | 252/455 |
| 4,431,516 | A | 2/1984 | Baird et al. | 208/111 |
| 4,431,517 | A | 2/1984 | Nevitt et al. | 208/111 |
| 4,431,519 | A | 2/1984 | LaPierre et al. | 208/111 |
| 4,436,614 | A | 3/1984 | Olbrich et al. | 208/89 |
| 4,510,045 | A | 4/1985 | Dessau | 208/111 |
| 4,568,449 | A | 2/1986 | Angmorter et al. | 208/216 |
| 4,594,146 | A | 6/1986 | Chester et al. | 208/111 |
| 4,684,756 | A | 8/1987 | Derr, Jr. | 585/330 |
| 4,784,747 | A | 11/1988 | Shihabi | 208/111 |

(Continued)

FOREIGN PATENT DOCUMENTS

| | | |
|---|---|---|
| EP | 0161833 | 11/1985 |

(Continued)

*Primary Examiner*—Tam M. Nguyen
(74) *Attorney, Agent, or Firm*—Estelle C. Bakun

(57) ABSTRACT

Dewaxed fuel and lubricant base stocks are made by (a) producing a synthesis gas from natural gas, (b) reacting the $H_2$ and CO in the gas in the presence of a cobalt Fischer-Tropsch catalyst, at reaction conditions effective to synthesize a waxy hydrocarbon feed boiling in the fuel and lubricant oil ranges, which is hydrodewaxed in a first stage to produce a dewaxed fuel and a partially dewaxed lubricant fraction. The partially dewaxed lubricant fraction is separated into heavy and lower boiling fractions each of which is separately hydrodewaxed, to produce lubricant base stocks. A hydrodewaxing catalyst comprising a hydrogenation component, binder and solid acid component used to hydrodewax at least one, and preferably at least two of the waxy feed and partially dewaxed heavy and lower boiling lubricant fractions.

30 Claims, 1 Drawing Sheet

U.S. PATENT DOCUMENTS

| | | | | |
|---|---|---|---|---|
| 4,808,296 | A | 2/1989 | Chen et al. | 208/111 |
| 4,908,120 | A | 3/1990 | Bowes et al. | 208/59 |
| 4,919,788 | A | 4/1990 | Chen et al. | 208/59 |
| 4,921,593 | A | 5/1990 | Smith | 208/59 |
| 4,954,325 | A | 9/1990 | Rubin et al. | 423/328 |
| 4,975,177 | A | 12/1990 | Garwood et al. | 208/27 |
| 5,015,361 | A | 5/1991 | Anthes et al. | 208/111 |
| 5,017,535 | A | 5/1991 | Schoonhoven et al. | 502/30 |
| 5,037,528 | A | 8/1991 | Garwood et al. | 208/27 |
| 5,059,299 | A | 10/1991 | Cody et al. | 208/27 |
| 5,075,269 | A | 12/1991 | Degnan et al. | 502/77 |
| 5,110,445 | A | 5/1992 | Chen et al. | 208/96 |
| 5,110,573 | A | 5/1992 | Johnson | 423/328 |
| 5,146,022 | A | 9/1992 | Buchanan et al. | 585/12 |
| 5,164,169 | A | 11/1992 | Rubin | 423/709 |
| 5,164,170 | A | 11/1992 | Rubin | 423/709 |
| 5,208,403 | A | 5/1993 | Buchanan et al. | 585/7 |
| 5,232,579 | A | 8/1993 | Absil et al. | 208/113 |
| 5,275,719 | A | 1/1994 | Baker, Jr. et al. | 208/58 |
| 5,276,229 | A | 1/1994 | Buchanan et al. | 585/255 |
| 5,284,985 | A | 2/1994 | Girgis et al. | 585/310 |
| 5,288,395 | A | 2/1994 | Marler et al. | 208/58 |
| 5,358,628 | A | 10/1994 | Apelian et al. | 208/60 |
| 5,362,378 | A | 11/1994 | Borghard et al. | 208/138 |
| 5,399,337 | A | 3/1995 | Schmitt | 423/705 |
| 5,405,596 | A | 4/1995 | Moini et al. | 423/705 |
| 5,419,830 | A | 5/1995 | Chou et al. | 208/111 |
| 5,456,820 | A | 10/1995 | Forbus, Jr. et al. | 208/111 |
| 5,475,178 | A | 12/1995 | Del Rossi et al. | 585/455 |
| 5,488,191 | A | 1/1996 | Chu et al. | 585/10 |
| 5,498,821 | A | 3/1996 | Ryan et al. | 585/750 |
| 5,516,736 | A | 5/1996 | Chang et al. | 502/64 |
| 5,603,822 | A | 2/1997 | Forbus, Jr. et al. | 208/111 |
| 5,603,824 | A | 2/1997 | Kyan et al. | 208/208 |
| 5,611,192 | A | 3/1997 | Weder | 53/221 |
| 5,612,270 | A | 3/1997 | Beck et al. | 502/64 |
| 5,637,784 | A | 6/1997 | Chu et al. | 585/14 |
| 5,643,440 | A | 7/1997 | Borghard et al. | 208/58 |
| 5,689,031 | A | 11/1997 | Berlowitz et al. | 585/734 |
| 5,730,858 | A | 3/1998 | Olivier et al. | 208/28 |
| 5,779,882 | A | 7/1998 | Chester et al. | 208/120 |
| 5,780,382 | A | 7/1998 | Chang et al. | 502/309 |
| 5,780,703 | A | 7/1998 | Chang et al. | 585/732 |
| 5,827,491 | A | 10/1998 | Emerson et al. | 423/328.2 |
| 5,833,840 | A | 11/1998 | Absil et al. | 208/120 |
| 5,849,968 | A | 12/1998 | Beck et al. | 585/481 |
| 5,854,170 | A | 12/1998 | Chang et al. | 502/308 |
| 5,885,438 | A | 3/1999 | Apelian et al. | 208/27 |
| 5,911,874 | A | 6/1999 | Cody et al. | 208/87 |
| 5,935,417 | A | 8/1999 | Cody et al. | 208/87 |
| 5,961,951 | A | 10/1999 | Kennedy et al. | 423/708 |
| 5,976,201 | A | 11/1999 | Barry et al. | 44/413 |
| 5,976,351 | A | 11/1999 | Apelian et al. | 208/27 |
| 5,993,644 | A | 11/1999 | Xiao et al. | 208/89 |
| 6,013,171 | A | 1/2000 | Cook et al. | 208/27 |
| 6,051,129 | A | 4/2000 | Harris et al. | 208/138 |
| 6,080,301 | A | 6/2000 | Berlowitz et al. | 208/18 |
| 6,080,904 | A | 6/2000 | Chang et al. | 585/751 |
| 6,090,989 | A | 7/2000 | Trewella et al. | 585/13 |
| 6,096,189 | A | 8/2000 | Cody et al. | 208/87 |
| 6,179,994 | B1 | 1/2001 | Clark et al. | 208/27 |
| 6,180,068 | B1 | 1/2001 | Boyd et al. | 422/195 |
| 6,180,575 | B1 | 1/2001 | Nipe | 508/227 |
| 6,190,532 | B1 | 2/2001 | Degnan et al. | 208/27 |
| 6,210,563 | B1 | 4/2001 | Tsao et al. | 208/138 |
| 6,217,747 | B1 | 4/2001 | Chang et al. | 208/112 |
| 6,231,749 | B1 | 5/2001 | Degnan et al. | 208/27 |
| 6,261,441 | B1 | 7/2001 | Gentry et al. | 208/58 |
| 6,264,826 | B1 | 7/2001 | Xiao et al. | 208/18 |
| 6,277,355 | B1 | 8/2001 | Kennedy et al. | 423/705 |
| 6,287,454 | B1 | 9/2001 | Forbus, Jr. et al. | 208/28 |
| 6,294,077 | B1 | 9/2001 | Dougherty et al. | 208/27 |
| 6,306,362 | B1 | 10/2001 | Han et al. | 423/702 |
| 6,310,265 | B1 | 10/2001 | Chester et al. | 585/739 |
| 6,319,487 | B1 | 11/2001 | Liu et al. | 423/706 |
| 6,322,692 | B1 | 11/2001 | Cody et al. | 208/18 |
| 6,332,974 | B1 | 12/2001 | Wittenbrink et al. | 208/18 |
| 6,337,010 | B1 | 1/2002 | Hofer | 208/58 |
| 6,339,051 | B1 | 1/2002 | Carey et al. | 508/391 |
| 6,346,498 | B1 | 2/2002 | Chang et al. | 502/64 |
| 6,362,123 | B1 | 3/2002 | Tsao et al. | 502/74 |
| 6,416,654 | B1 | 7/2002 | Chou et al. | 208/27 |
| 6,420,063 | B1 | 7/2002 | Ozin et al. | 429/40 |
| 6,504,075 | B1 | 1/2003 | Beck et al. | 585/475 |
| 6,506,703 | B1 | 1/2003 | Kao et al. | 502/66 |
| 2001/0001449 | A1 | 5/2001 | Kiliany et al. | 208/111.01 |
| 2001/0004972 | A1 | 6/2001 | Miller et al. | 208/18 |
| 2001/0006154 | A1 | 7/2001 | Krug et al. | 208/18 |
| 2002/0003102 | A1 | 1/2002 | O'Rear et al. | 208/18 |

FOREIGN PATENT DOCUMENTS

| | | | |
|---|---|---|---|
| EP | 0147873 | B1 | 3/1988 |
| EP | 0635557 | A1 | 1/1995 |
| EP | 0707057 | A1 | 4/1996 |
| EP | 0909304 | B1 | 4/1999 |
| EP | 0668342 | B1 | 8/1999 |
| GB | 772478 | | 4/1957 |
| GB | 1582789 | | 1/1981 |
| GB | 2109402 | | 6/1983 |
| GB | 2311789 | | 10/1997 |
| WO | WO 96/13563 | | 5/1996 |
| WO | WO 96/26993 | | 9/1996 |
| WO | WO 96/34930 | | 11/1996 |
| WO | WO 97/18278 | | 5/1997 |
| WO | WO 98/18883 | | 5/1998 |
| WO | WO 99/34917 | * | 7/1999 |
| WO | WO 99/35087 | | 7/1999 |
| WO | WO 01/57166 | A1 | 8/2001 |
| WO | WO 0164339 | A1 | 9/2001 |
| WO | WO 02/064710 | | 8/2002 |
| WO | WO 02/070629 | | 9/2002 |

* cited by examiner

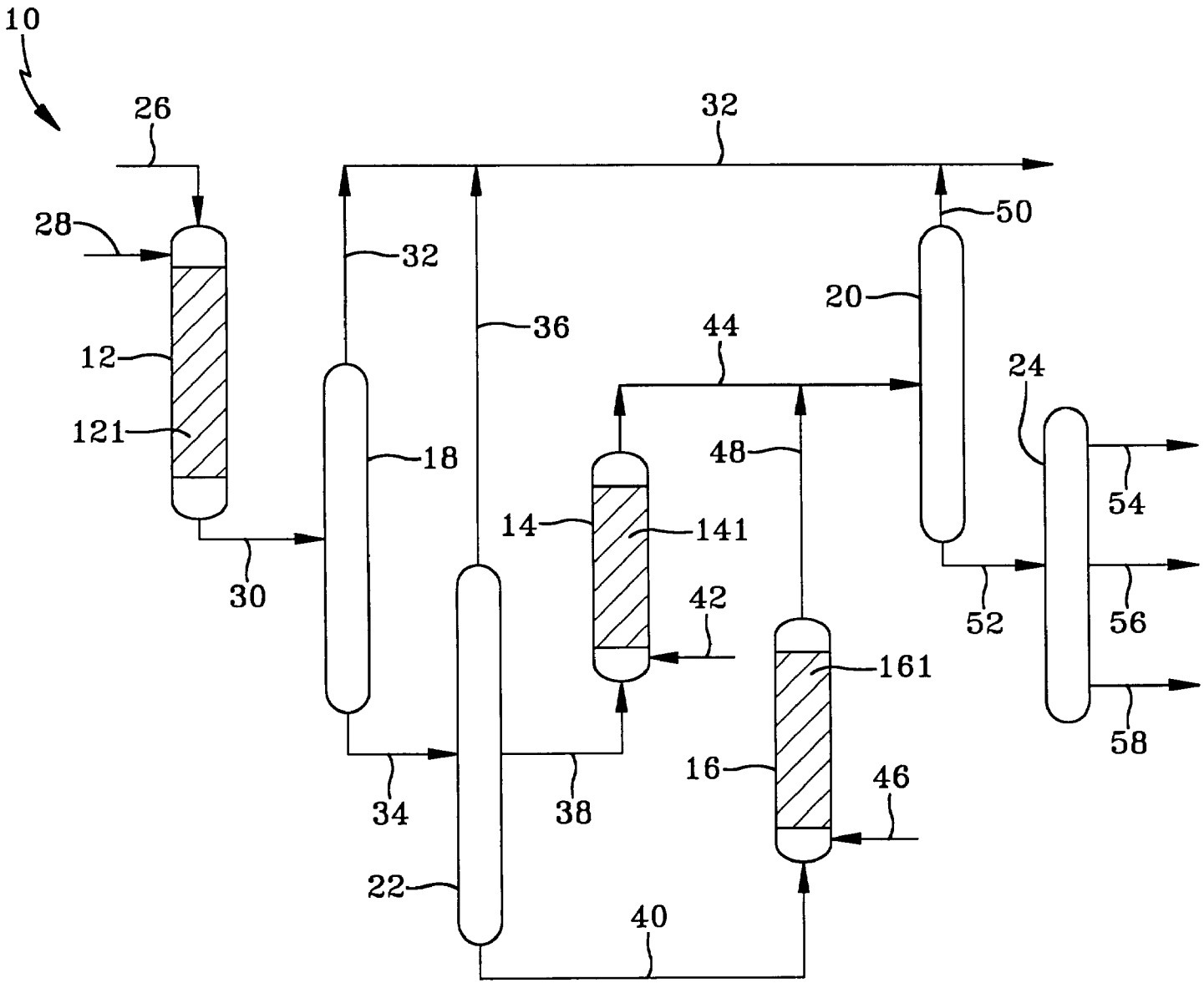
10
26
28
12
121
30
32
18
32
36
34
22
14
38
40
44
141
42
48
16
161
46
20
50
52
24
54
56
58

PRODUCTION OF FUELS AND LUBE OILS FROM FISCHER-TROPSCH WAX

BACKGROUND OF THE DISCLOSURE

Field of the Invention

The invention relates to producing fuels and lubricant oils from Fischer-Tropsch wax. More particularly the invention relates to a multi-stage process to produce fuels and lubricant oils from wax synthesized by reacting $H_2$ and CO produced from natural gas in the presence of a cobalt Fischer-Tropsch catalyst, by hydrodewaxing the wax to produce dewaxed fuel and a partially dewaxed, heavier fraction in a first stage. The heavier fraction is split into light and heavy fractions boiling in the lubricant oil range, which are further hydrodewaxed in separate stages, to produce both light and heavy lubricant base stocks.

BACKGROUND OF THE DISCLOSURE

The relatively pure waxy and paraffinic hydrocarbons synthesized by the Fischer-Tropsch process are excellent sources of diesel fuel, jet fuel and premium lubricant oils with low sulfur, nitrogen and aromatics. When produced by a cobalt catalyst, the sulfur, nitrogen and aromatics content of the waxy hydrocarbons is essentially nil and they can therefore be passed to upgrading operations without prior hydrogen treatment. In a Fischer-Tropsch hydrocarbon synthesis process, a synthesis gas comprising $H_2$ and CO is fed into a hydrocarbon synthesis reactor, in which the $H_2$ and CO react in the presence of a Fischer-Tropsch catalyst to produce waxy hydrocarbons. The waxy hydrocarbon fraction that is liquid at the synthesis reaction conditions and solid at ambient room temperature and pressure conditions, is referred to as Fischer-Tropsch wax, and typically includes hydrocarbons boiling in both the fuels and lubricant oil ranges. However, these fuel and lubricant fractions have cloud and pour points too high to be useful as fuels and lubricant oils and must therefore be further processed (e.g., dewaxed), to acceptably low cloud and pour points. Fischer-Tropsch synthesis using a non-shifting cobalt catalyst produces more of the higher molecular weight hydrocarbons boiling in the lubricant range, than does a shifting catalyst, such as iron. Various processes have been disclosed for catalytically dewaxing these and other waxy hydrocarbons. Some, such as those employing a ZSM-5 catalyst, dewax by hydrocracking the waxy hydrocarbons to products boiling below the lubricant oil range. This results in a substantial loss of lubricant and higher boiling fuel, with concomitant low product yield. Others hydrorefine the wax to remove sulfur, nitrogen, oxygen containing molecules (oxygenates) and aromatics prior to dewaxing, to reduce deactivation of the dewaxing catalyst. The problem of high conversion and concomitant low product yield is exacerbated, when dewaxing a waxy, heavy lubricant oil fraction to an acceptable cloud point. Illustrative, but nonlimiting examples of various catalytic dewaxing processes are disclosed in, for example, U.S. Pat. Nos. 6,179,994; 6,090,989; 6,080,301; 6,051,129; 5,689,031 and 5,075,269 and EP 0 668 342 B1. There is still a need for a process that will produce acceptable yields of both fuels and lubricant base stocks, including a heavy lubricant base stock, from Fischer-Tropsch wax.

SUMMARY OF THE INVENTION

In one embodiment the invention relates to a multi-stage hydrodewaxing process for producing fuels and lubricant base stocks, including a heavy lubricant base stock, from Fischer-Tropsch wax having hydrocarbon fractions boiling in the fuel and lubricant oil boiling ranges. In another embodiment the invention relates to (a) producing a synthesis gas from natural gas, (b) reacting the $H_2$ and CO in the gas in the presence of a cobalt Fischer-Tropsch catalyst, at reaction conditions effective to synthesize waxy hydrocarbons, including fractions boiling in the fuel and lubricant oil ranges, and (c) dewaxing the waxy hydrocarbons in a multi-stage hydrodewaxing process to produce hydrodewaxed fuel and lubricant base stocks. A process in which natural gas is converted to synthesis gas which, in turn, is converted to hydrocarbons, is referred to as a gas conversion process. Thus, this embodiment relates to a gas conversion process plus product upgrading by hydrodewaxing. The multi-stage hydrodewaxing process comprises (i) hydrodewaxing the wax or waxy feed, to produce an isomerate comprising a dewaxed fuel fraction and a partially dewaxed lubricant oil fraction, (ii) separating these two fractions, (iii) separating the partially dewaxed lubricant oil fraction into a heavy lubricant fraction and a lower boiling fraction, and (iv) separately hydrodewaxing the heavy and lower boiling fractions, under different reaction conditions, to produce heavy and lower boiling lubricant base stocks.

By hydrodewaxing is meant the waxy feed and partially dewaxed lubricant oil fractions are contacted with hydrogen, and a hydrodewaxing catalyst that dewaxes mostly by isomerization as opposed to hydrocracking. This excludes dewaxing catalysts, such as ZSM-5, which dewax mostly by hydrocracking the waxy molecules, particularly the heavy lubricant fraction, to hydrocarbons boiling below the desired product range. A hydrodewaxing catalyst comprising a ZSM-48 zeolite (ZSM-48 zeolites herein include EU-2, EU-11 and ZBM-30 which are structurally equivalent to ZSM-48) component and a hydrogenation component, has been found to be particularly useful in the process of the invention. This process and catalyst combination have been found to produce dewaxed fuel and lubricant base stocks, including a heavy lubricant base stock, having acceptably low cloud and pour points, with relatively high product yield.

By fuel is meant a dewaxed hydrocarbon fraction, boiling somewhere in the range of from about $C_5$ up to about 550–730° F. (288–388° C.) and includes naphtha, diesel and jet fuel. In the context of the invention, the heavy fraction comprises a heavy lubricant oil fraction which, when dewaxed, comprises a heavy lubricant base stock. The lower boiling fraction comprises light and medium lubricant oil fractions boiling below the heavy lubricant oil fraction and which, when dewaxed, comprise light and medium oil base stocks. Thus, by lower boiling base stock is meant to include at least one lower boiling lubricant base stock and more typically a plurality of lower boiling lubricant base stocks in the medium and/or light lubricant oil boiling ranges. By lubricant base stock, is meant a lubricant oil having an initial boiling point above 600° F. (316° C.) and more typically at least about 700–750° F. (371–399° C.), that has been hydrodewaxed to the desired pour and cloud points. By heavy lubricant fraction is meant hydrocarbons having an initial boiling point in the range of from about 850° F. (454° C.) or above, preferably from 850–950° F. (454–510° C.) and an end point above 1,000° F. (538° C.). A heavy lubricant base stock has an initial boiling point in the range of from about 850–1000° F. (454–538° C.,) with an end boiling point above 1,000° F. (538° C.) and preferably above 1050° F. (566° C.). The initial and end boiling points values referred to herein are nominal and refer to the T5 and T95 cut points obtained by gas chromatograph distillation (GCD), using the method set forth below. By partially dewaxed is meant that the respective fraction has been dewaxed to lower the pour point below that which it had prior to being partially dewaxed, but not as low as the desired pour point, which is achieved by further dewaxing the partially dewaxed fraction in the next successive dewaxing reaction stage. By different reaction conditions to produce heavy and lower boiling lubricant base stocks under (iv) above, is meant that the heavy lubricant fraction is dewaxed at more severe reaction conditions than the lower boiling fraction. This is achieved by dewaxing the heavier or higher boiling fraction at reaction conditions that include one or more of (a) a temperature of at least 5° F. (3° C.) and preferably at least 10° F. (6° C.) higher and/or (b) a space velocity of at least 10% and preferably at least 20% lower, than the temperature and/or space velocity used to dewax the lower boiling fraction.

BRIEF DESCRIPTION OF THE DRAWING

The FIGURE is a simple schematic flow diagram of one embodiment of the hydrodewaxing process of the invention.

DETAILED DESCRIPTION

In the process of the invention, the Fischer-Tropsch wax feed is hydrodewaxed to produce an isomerate effluent comprising dewaxed fuel and a partially dewaxed lubricant oil hydroisomerate. The dewaxed fuel is separated from the partially dewaxed lubricant isomerate. The partially dewaxed lubricant isomerate is then separated into a heavy fraction and a lighter, or lower boiling fraction, each of which is further hydrodewaxed, separately and under different dewaxing reaction conditions, to produce isomerate effluents comprising heavy and lower boiling lubricant base stocks. As set forth above, the partially dewaxed heavy lubricant isomerate, produced by hydrodewaxing the Fischer-Tropsch wax feed, is further hydrodewaxed at more severe conditions than is the lighter lubricant isomerate. The hydrodewaxing reaction reduces the pour and cloud points. In the hydrodewaxing process of the invention, the raw Fischer-Tropsch wax feed produced by a cobalt catalyst and preferably a non-shifting cobalt catalyst, need not be treated to remove aromatics, unsaturates or heteroatoms (including oxygenates), before it is passed into the first hydrodewaxing stage. A lubricant base stock produced by this process is typically hydrofinished and optionally dehazed at mild conditions, to improve color and stability, to form a finished lubricant base stock. As is known, haze is cloudiness or a lack of clarity, and is an appearance factor. Dehazing is typically achieved by either catalytic or absorptive methods to remove those constituents that result in haziness. Hydrofinishing is a very mild, relatively cold hydrogenating process, which employs a catalyst, hydrogen and mild reaction conditions to remove trace amounts of heteroatom compounds, aromatics and olefins, to improve oxidation stability and color. Hydrofinishing reaction conditions include a temperature of from 302 to 662° F. (150 to 350° C.) and preferably from 302 to 550° F. (150 to 288° C.), a total pressure of from 400 to 3000 psig (2859 to 20786 kPa), a liquid hourly space velocity ranging from 0.1 to 5 LHSV ($hr^{-1}$) and preferably 0.5 to 3 $hr^{-1}$. The hydrogen treat gas rate will range from 250 to 10000 scf/B (44.5 to 1780 $m3/m^3$). The catalyst will comprise a support component and one or more catalytic metal components of metal from Groups VIB (Mo, W, Cr) and/or iron group (Ni, Co) and/or noble metals (Pt, Pd) of Group VIII. The Groups VIB and VIII referred to herein, refers to Groups VIB and VIII as found in the Sargent-Welch Periodic Table of the Elements copyrighted in 1968 by the Sargent-Welch Scientific Company. The metal or metals may be present from as little as 0.1 wt % for noble metals, to as high as 30 wt % of the catalyst composition for non-noble metals. Preferred support materials are low in acid and include, for example, amorphous or crystalline metal oxides such as alumina, silica, silica alumina and ultra large pore crystalline materials known as mesoporous crystalline materials, of which MCM-41 is a preferred support component. The preparation and use of MCM-41 is disclosed, for example, in U.S. Pat. Nos. 5,098,604, 5,227,353 and 5,573,657.

A lubricant base stock comprises a dewaxed oil boiling within the lubricant oil boiling range, having low temperature properties, including pour and cloud points, sufficiently lower than what the respective fraction had prior to the hydrodewaxing, to meet desired specifications or requirements.

A lubricant or finished lubricant product (these two terms are used herein synonymously), is prepared by forming a mixture of a lubricant base stock described herein and an effective amount of at least one additive or, the more typically, an additive package containing more than one additive. Illustrative, but non-limiting examples of such additives include one or more of a detergent, a dispersant, an antioxidant, an antiwear additive, an extreme pressure additive, a pour point depressant, a VI improver, a friction modifier, a demulsifier, an antioxidant, an antifoamant, a corrosion inhibitor, and a seal swell control additive. The heavy lubricant base stock used in forming the mixture is typically one that has been mildly hydrofinished and/or dehazed after hydrodewaxing, to improve its color, appearance and stability. Low temperature property requirements will vary and some depend on the geographical location in which the fuel or lubricant will be used. For example, jet fuel must have a freeze point of no higher than −47° C. Diesel fuel has respective summer and winter cloud points, varying by global region, from −15 to +5° C. and −35 to −5° C. Low temperature properties for conventional light and medium lubricant base stocks, may include a pour point of about −20° C. and a cloud point typically no more than 15° C. higher. A heavy base stock will typically be clear and bright at room temperature and pressure conditions of 75° F. (24° C.) and one atmosphere (101 kPa) pressure. However, in some cases the cloud point may be higher than 75° F.

The Fischer-Tropsch wax feed (hereinafter "wax") is hydrodewaxed in the first stage, which preferably comprises a separate reactor and may include one or more hydrodewaxing zones, through which the effluent from a preceding zone is passed. The second and third stages may comprise the same or different reactors, in which the partially dewaxed and separated heavy and lower boiling lubricant isomerate fractions produced in the first stage are further hydrodewaxed, separately and in separate stages, at different hydrodewaxing conditions, to produce the lubricant base stocks. One reactor may be used for both the heavy and lower boiling lubricant oil isomerate fractions, if employed in blocked fashion, with only one fraction passing through at a time. However, this requires additional pumps and tankage for storage. As with the wax feed hydrodewaxing reaction stage, each of the two lubricant hydrodewaxing reaction stages may comprise one or more hydrodewaxing reaction zones, each defined by a catalyst bed. In the practice of the invention, it is preferred to employ only three hydrodewaxing reaction stages; (i) one for the waxy feed, (ii) one for the partially hydrodewaxed lower boiling lubricant isomerate fraction produced in the first stage and (iii) one for the partially hydrodewaxed heavy lubricant isomerate fraction produced in the first stage. However, if desired, more than one stage may be used for the wax feed and/or for one or more of the partially dewaxed lubricant isomerate fractions. By stage is meant one or more hydrodewaxing reaction zones, with no interzone separation of reaction products and typically, but not necessarily, refers to a separate hydrodewaxing reactor. The wax feed hydrodewaxing stage is typically operated at milder conditions than the two respective lower boiling and heavy lubricant oil isomerate hydrodwaxing stages. The heavy lubricant stage is typically operated at the most severe conditions. This minimizes conversion of the fuel and lubricant oil fractions to lower boiling product, and maximizes both fuel and lubricant base stock yield. Those skilled in the art know that severity increases with increasing reaction temperature and decreasing space velocity. Hydrodewaxing reaction conditions employed in the process of the invention include a respective temperature, hydrogen partial pressure and space velocity broadly ranging from 450–750° F. (232–399° C.), 10–2,000 psig (69–13790 kPa), and a space velocity (liquid hourly space velocity or LHSV) of 0.1–5.0. These conditions will more generally range from 500–700° F. (260–371° C.), 100–1000 psig (690–6895 kPa) and an LHSV of 0.5–3.0, with a pressure of from 200–700 psig (1379–4827 kPa) more typical.

It is known that in a Fischer-Tropsch hydrocarbon synthesis process, liquid and gaseous hydrocarbon products are formed by contacting a synthesis gas comprising a mixture of $H_2$ and CO with a Fischer-Tropsch catalyst, in which the $H_2$ and CO react to form hydrocarbons under shifting or non-shifting conditions and, in the process of the invention, under non-shifting conditions in which little or no, and preferably no water gas shift reaction occurs, particularly when the catalytic metal comprises Co. The synthesis gas typically contains less than 0.1 vppm and preferably less than 50 vppb of sulfur or nitrogen in the form of one or more sulfur and nitrogen-bearing compounds. Methods for removing nitrogen and sulfur from synthesis gas down to these very low levels are known and disclosed in, for example, U.S. Pat. Nos. 6,284,807; 6,168,768; 6,107,353 and 5,882,614. In the process of the invention, the cobalt Fischer-Tropsch catalyst comprises a catalytically effective amount of Co and optionally one or more promoters such as Re, Ru, Ni, Th, Zr, Hf, U, Mg and La on a suitable inorganic support material, preferably one which comprises one or more refractory metal oxides. Preferred supports for Co containing catalysts comprise titania, particularly when employing a slurry hydrocarbon synthesis process in which higher molecular weight, mostly paraffinic liquid hydrocarbon products are desired. Useful catalysts and their preparation are known and illustrative, but nonlimiting examples may be found, for example, in U.S. Pat. Nos. 4,568,663; 4,663,305; 4,542,122; 4,621,072 and 5,545,674. Fixed bed, fluid bed and slurry hydrocarbon synthesis processes are well known and documented in the literature. In all of these processes the synthesis gas is reacted in the presence of a suitable Fischer-Tropsch type of hydrocarbon synthesis catalyst, at reaction conditions effective to form hydrocarbons. Some of these hydrocarbons will be liquid, some solid (e.g., wax) and some gas at standard room temperature conditions of temperature and pressure of 25° C. and one atmosphere (101 kPa) pressure. Slurry Fischer-Tropsch hydrocarbon synthesis processes are often preferred, because when a cobalt catalyst, and preferably a non-shifting cobalt catalyst is used, they are able to produce relatively high molecular weight, paraffinic hydrocarbons useful for lubricant and heavy lubricant base stocks. By non-shifting is meant that less than 5 wt % and preferably less than 1 wt % of the carbon in the feed CO is converted to $CO_2$. It is also preferred to conduct the synthesis reaction under conditions to synthesize more of the more desirable higher molecular weight hydrocarbons useful for fuels and lubricants. In order to achieve this, the synthesis reactor is operated under conditions to produce at least 14 pounds of 700° F.+ (371° C.) hydrocarbons per 100 pounds of CO converted to hydrocarbons and preferably at least 20 pounds of 700° F.+ (371° C.) hydrocarbons for every 100 pounds of CO converted to hydrocarbons. Preferably less than 10 pounds of methane are formed for every 100 pounds of CO converted. Increasing the amount of 700° F.+ (371° C.) hydrocarbons produced in the synthesis reactor is achieved by one or more of (a) decreasing the $H_2$:CO mole ratio in the synthesis feed gas, (b) decreasing the reaction temperature, and (c) increasing the reaction pressure. These high 700° F.+ (371° C.) hydrocarbon production levels have been achieved in a slurry hydrocarbon synthesis reactor, using a catalyst having a rhenium promoted cobalt component and a titania support component. Increasing the amount of 700° F.+ (371° C.) hydrocarbons produced in the synthesis reactor is achieved by one or more of (a) decreasing the $H_2$:CO mole ratio in the synthesis feed gas, (b) decreasing the reaction temperature, and (c) increasing the reaction pressure.

In a hydrocarbon synthesis process conducted under non-shifting conditions with a cobalt catalyst, the mole ratio of the $H_2$ to CO in the synthesis gas is preferably the stoichiometric consumption mole ratio, which is typically about 2.1/1. The synthesis gas comprising a mixture of $H_2$ and CO is passed into the reactor (injected or bubbled up into the bottom of the slurry body in a slurry synthesis reactor), in which the $H_2$ and CO react in the presence of the Fischer-Tropsch hydrocarbon synthesis catalyst, at conditions effective to form hydrocarbons, a portion of which are liquid at the reaction conditions (and which comprise the hydrocarbon slurry liquid in a slurry reactor). In a slurry reactor, the synthesized hydrocarbon liquid is separated from the catalyst particles as filtrate by means such as simple filtration, although other separation means can be used. Some of the synthesized hydrocarbons are vapor and pass out of the hydrocarbon synthesis reactor as overhead gas, along with unreacted synthesis gas and gaseous reaction products. Some of these overhead hydrocarbon vapors are typically condensed to liquid and combined with the hydrocarbon liquid filtrate. Thus, the initial boiling point of the synthesized hydrocarbons removed from the reactor as liquid will vary depending on whether or not some of the condensed hydrocarbon vapors have been combined with it. Hydrocarbon synthesis process conditions vary somewhat depending on the catalyst, reactor and desired products. Typical conditions effective to form hydrocarbons comprising mostly $C_{5+}$ paraffins, (e.g., $C_{5+}$–$C_{200}$) and preferably $C_{10+}$ paraffins, in a fixed bed, fluidized bed or slurry hydrocarbon synthesis process employing a catalyst comprising a supported cobalt component include, for example, temperatures, pressures and hourly gas space velocities in the range of from about 320–600° F., 80–600 psi and 100–40,000 V/hr/V, expressed as standard volumes of the gaseous CO and $H_2$ mixture (60° F., 1 atm) per hour per volume of catalyst, respectively. In the practice of the invention, the waxy hydrocarbons or wax feed may be produced in a slurry, fixed or fluidized bed Fischer-Tropsch reactor.

The wax feed for the first hydrodewaxing stage may comprise all or a portion of the synthesized hydrocarbons that are liquid at the hydrocarbon synthesis reaction conditions in the synthesis reactor and removed therefrom as liquid. A portion of the hydrocarbons that are normally gas or vapor at the reaction conditions are typically entrained in the liquid effluent. The vaporous effluent from the Fischer-Tropsch hydrocarbon synthesis reactor may be cooled to condense and recover some of the synthesized hydrocarbons that are vapor at the reaction conditions, and all or a portion of this condensate may be combined with the liquid effluent. Therefore, the initial boiling point of the wax will vary, depending on the reactor, catalyst, conditions, amount of condensate combined with the liquid effluent, and the desired product slate. This will also result in some variations in wax composition. If desired, one or more fractions boiling in the fuel and/or lubricant boiling range may be removed from the wax, before it is fed into the first hydrodewaxing stage. Therefore, in the process of the invention, the wax fed into the first hydrodewaxing reactor, may or may not boil continuously from its initial boiling point, up to its end boiling point. Thus, the entire wax fraction (e.g., 400–450° F.+ (204–232° C.+)) may or may not be fed into the first hydrodewaxing stage. The initial boiling point of the wax feed may be above the 400–450° F. (204–232° C.) range, as long as at least a portion, preferably at least 25 wt %, more preferably at least 50 wt % and most preferably all, of the lower boiling fuels hydrocarbons (e.g., ~650° F.− (343° C.−)) remain in the wax feed passed into the first hydrodewaxing stage.

In the illustrative, but nonlimiting example below, the wax was produced in a slurry Fischer-Tropsch reactor, containing a rhenium promoted cobalt catalyst having a titania support component and had an initial boiling point of about 430° F. (221° C.). Lower boiling naphtha hydrocarbons ($C_{5+}$–430° F. (231° C.)) produced by the synthesis reaction, were not combined with the higher boiling, liquid reactor effluent. This wax typically comprises 90 or more weight percent paraffins, with from 2–4 wt % oxygenates and 2–5 wt % olefins, depending on the reaction conditions. Aromatics were not detectable by NMR analysis. This wax contains less than 50 wppm sulfur and less than 50 wppm nitrogen. The iso- to normal paraffin ratio is measured by performing GC-FID or adding on product with up to 20 carbon atoms and in combination with $^{13}$C-NMR for products≧carbon atoms.

The same hydrodewaxing catalyst may be used for dewaxing both the wax feed and the heavy lubricant fraction, and may comprise any suitable catalyst that dewaxes mostly by isomerization and not by cracking. By catalyst is meant a catalyst comprising a hydrogenation component, a binder and a solid acid component preferably a zeolite.

Illustrative, but nonlimiting examples of suitable catalyst components useful for hydrodewaxing include, for example, ZSM-23, ZSM-35, ZSM-48, ZSM-57, ZSM-22 also known as theta one or TON, and the silica aluminophosphates known as SAPO's (e.g., SAPO-11, 31 and 41), SSZ-32, zeolite beta, mordenite and rare earth ion exchanged ferrierite. Also useful are alumina and amorphous silica aluminas.

As in the case of many other zeolite catalysts, it may be desired to incorporate the solid acid component with a matrix material also known as a binder, which is resistant to the temperatures and other conditions employed in the dewaxing process herein. Such matrix materials include active and inactive materials and synthetic or naturally occurring zeolites as well as inorganic materials such as clays, silica and/or metal oxides e.g., alumina. The latter may be either naturally occurring or in the form of gelatinous precipitates, sols or gels including mixtures of silica and metal oxides. Use of a material in conjunction with the solid acid component, i.e., combined therewith, which is active, may enhance the conversion and/or selectivity of the catalyst herein. Inactive materials suitably serve as diluents to control the amount of conversion in a given process so that products can be obtained economically and orderly without employing other means for controlling the rate or reaction. Frequently, crystalline silicate materials have been incorporated into naturally occurring clays, e.g., bentonite and kaolin. These materials, i.e., clays, oxides, etc., function, in part, as binders for the catalyst. It is desirable to provide a catalyst having good crush strength since in a petroleum refinery the catalyst is often subject to rough handling which tends to break the catalyst down into powder-like materials which cause problems in processing.

Naturally occurring clays which can be composited with the solid acid component include the montmorillonite and kaolin families which include the sub-bentonites, and the kaolins commonly known as Dixie, McNamee, Georgia and Florida clays, or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the solid acid component can be composited with a porous matrix material such as silica-alumina, silica-magnesia, silica-zirconia, silica-thoria, silica-beryllia, silica-titania, as well as ternary compositions such as silica-alumina-thoria, silica-alumina-zirconia, silica-alumina-magnesia and silica-magnesia-zirconia. The matrix can be in the form of a cogel. Mixtures of these components can also be used. The relative proportions of finely divided solid acid component and inorganic oxide gel matrix vary widely with the crystalline silicate content ranging from about 1 to about 90 percent by weight, and more usually in the range of about 2 to about 80 percent by weight, of the composite.

On the other hand, it is preferred that the catalyst used to produce the lower boiling lubricant base stock, by further hydrodewaxing the partially hydrodewaxed lower boiling lubricant oil fraction produced in the first stage, comprise a ZSM-48 catalyst. By ZSM-48 catalyst is meant a catalyst that comprises a hydrogenation component and a ZSM-48 zeolite component, preferably the hydrogen form. In a preferred embodiment, the ZSM-48 catalyst is also used for hydrodewaxing the partially hydrodewaxed heavy lubricant fraction, to produce the heavy lubricant oil base stock. It is preferred to use a ZSM-48 catalyst to hydrodewax the heavy lubricant oil fraction in at least one stage. This could be the first or wax feed stage or any one or more subsequent stages in which only the heavy fraction is hydrodewaxed. In a more preferred embodiment, the ZSM-48 catalyst is used for all three hydrodewaxing stages. That is, the ZSM-48 catalyst is used to hydrodewax the wax feed and the partially dewaxed lower boiling and heavy lubricant oil isomerates produced by hydrodewaxing the wax feed. Other hydrodewaxing catalysts useful in the practice of the invention, include any catalyst that dewaxes mostly by isomerization and not by cracking or hydrocracking. Zeolites and other molecular sieves comprising ten and twelve membered ring structures are useful as dewaxing catalysts, particularly when combined with a catalytic metal hydrogenating component. Illustrative, but nonlimiting examples of suitable catalyst components useful for hydrodewaxing include, for example, ZSM-23, ZSM-35, ZSM-48, ZSM-57, ZSM-22 also known as theta one or TON, and the silica aluminophosphates known as SAPO's (e.g., SAPO-11, 31 and 41), SSZ-32, zeolite beta, mordenite and rare earth ion exchanged ferrierite. Also useful are alumina and amorphous silica aluminas. The hydrogenation component will comprise at least one Group VIII metal component and preferably at least one noble Group VIII metal component, as in Pt and Pd. Noble metal concentrations will range from about 0.1–5 wt % of the metal, and more typically from about 0.2–1 wt %, based on the total catalyst weight, including the ZSM-48 zeolite component and any binder used in the catalyst composite. The Group VIII referred to herein refers to Group VIII as found in the Sargent-Welch Periodic Table of the Elements copyrighted in 1968 by the Sargent-Welch Scientific Company. Hydrodewaxing experiments conducted with Fischer-Tropsch wax, have revealed that the ZSM-48 catalyst is superior to others, including, for example, rare earth ion exchanged ferrierite, mordenite, zeolite beta, SAPO-11, TON and ZSM-23, all using a Pt hydrogenating component. It is also superior to Pd/amorphous silica alumina (20% silica). In experiments using a dewaxing catalyst comprising only Pt on either zeolite beta or amorphous silica alumina, about 50 wt % of the 950° F.+ (610° C.) fraction was converted to hydrocarbons boiling in the fuels range. Experiments have shown the ZSM-48 catalyst is more selective to lubes production, which means less 700° F.+ (371° C.) wax feed conversion to 700° F.− (371° C.−) hydrocarbons. The preparation of ZSM-48 is well known and is disclosed, for example, in U.S. Pat. Nos. 4,397,827; 4,585,747 and 5,075,269, and EP 0 142 317, the disclosures of which are incorporated herein by reference. The 700° F.+ (371° C.+) conversion is calculated as follows:

700° F.+ conversion=[1−(wt %700° F.+ fraction in product)/(wt %700° F.+ in feed)]×100

The FIGURE represents one embodiment of the multi-stage portion of the process of the invention and is intended to be an illustrative, but nonlimiting example. Referring now to the FIGURE, a three stage hydrodewaxing unit 10 of the invention comprises hydrodedwaxing reactors 12, 14 and 16, each being a separate reactor and containing one or more fixed beds of a hydrodewaxing catalyst. The respective catalyst beds are simply indicated as 121, 141 and 161. The hydrodewaxing catalyst in each reactor is the same and comprises a ZSM-48 zeolite component and a hydrogenation component. The ZSM-48 zeolite is the hydrogen form and the hydrogenation component comprises platinum. The amount of platinum is 0.6 wt %, based on the total catalyst weight. An untreated, raw wax feed, comprising the 450° F.+ (232° C.+) hydrocarbon fraction produced by a Fischer-Tropsch slurry reactor (not shown), employing a titania supported, rhenium promoted cobalt catalyst and operating at conditions to produce to produce at least 14 pounds of 700° F.+ (371° C.+) hydrocarbons per 100 pounds of CO converted to hydrocarbons, is fed into 12 via line 26. The wax continuously boils from its initial boiling point, up to its end boiling point, which is greater than 1050° F. (566° C.)). This wax comprises 72 wt % 700° F.+ (371° C.) and 26 wt % 1000° F.+ (538° C.), mostly normal paraffins. Hydrogen enters reactor 12 via line 28. Reactor 12 operates at conditions of 586° F. (308° C.), a hydrogen pressure of 250 psig (1724 kPa), an LHSV of 1 and a hydrogen gas rate of 2500 SCF/B. The wax feed is hydrodewaxed in 12 to produce an isomerate effluent comprising dewaxed naphtha and diesel fuel fractions, and a partially dewaxed, 750° F.+ (371° C.) lubricant oil fraction. The diesel fraction (~320–700° F. (160–371° C.)) has respective cloud and pour points of −15° C. and −35° C. This effluent is passed, via line 30, into an atmospheric pressure fractionater 18, which separates the fuel and lubricant fractions. The fuel is removed via line 32 and the 750° F.+ (371° C.) lubricant fraction is removed via line 34. Line 34 passes the partially hydrodewaxed isomerate lubricant fraction into a vacuum fractionater 22, which separates it into a heavy (950° F.+ (610° C.)) and a lower boiling (700–950° F. (371–610° C.)) lubricant fraction. The lower boiling lubricant fraction is removed from 22 via line 38 and passed into hydrodewaxing reactor 14. The heavy lubricant fraction is removed via line 40 and passed into hydrodewaxing reactor 16. A minor amount of entrained middle distillate, 725° F.− (385° C.−) material, is removed from 22, via line 36, and passed into line 32. Reactor 14 operates at a temperature and pressure of 597° F. (314° C.) and 245 psig (1689 kPa) hydrogen, while reactor 16 operates at 616° F. (324° C.) and 250 psig (1724 kPa) hydrogen. The LHSV and hydrogen gas space velocity in these reactors is the same as in reactor 12. The heavy and lower boiling fractions are further dewaxed in their respective hydrodewaxing reactors 14 and 16, to produce base stock oils of the desired pour points. Hydrogen enters reactor 14, via line 42 and reactor 16, via line 46. Reactors 14 and 16 produce hydrodewaxed effluents respectively comprising a light/medium lubricant (isomerate) base stock fraction, having a pour point of about −21° C. and a heavy (1000° F.+ (538° C.)) lubricant (isomerate) base stock fraction having a cloud point of about +8° C. The hydrodewaxed effluents produced in 14 and 16, are respectively removed via lines 44 and 48, combined in 44, and passed into atmospheric fractionater 20. In another embodiment (not shown), the hydrodewaxed lubricant base stock effluents from 14 and 16 are each passed into a separate, sequential train of atmospheric and vacuum fractionaters, instead of being combined and fed into a single train, as shown in the FIGURE. In fractionater 20, lower boiling, 725° F.− (385° C.) hydrocarbons formed by the conversion of some of the 725° F.+ (385° C.) hydrocarbons in 14 and 16, are separated from the 725° F.+ (385° C.) lubricant base stock material and removed via line 50. The 700° F.− (371° C.−) hydrocarbons in line 50 are combined with the fuels hydrocarbons in line 32 and passed, via line 32, to either tankage or further processing. Based on the wax fed into 12, fractionaters 18, 20 and 22 pass a combined total of about 7 wt % naphtha, 45 wt % diesel and 1 wt % of a light (e.g., 700° F.+ ((371° C.+)) lubricant base stock into line 32. The 700° F.+ (371° C.+) base stock fraction is removed from 20 via line 52 and fed into vacuum fractionater 24 which, by way of illustration, separates it into light, medium and heavy (1000° F.+ (538° C.+)) lubricant base stocks, having respective viscosities of 3.8 cSt, 6.0 cSt and 15.7 cSt. These base stocks are removed from 20 via lines 54, 56 and 58, sent to hydrofinishing and optionally dehazing (not shown) to improve color stability and appearance, and then to tankage. Based on the wax fed into reactor 12, a total of 30–52 wt %/o of lubricant base stock oil is recovered from fractionater 24. This includes 12–20 wt % of the 3.8 cSt stock, 10–18 wt % of the 6.0 cSt stock and 8–14 wt % of the 15.7 cSt stock fractions. The cloud/pour points of these three stocks are −8.6/−30° C., −7.6/−21° C., and 6.8/−26° C., respectively. Overall, a 700° F.+ lubricant base stock yield of from about 70–75 wt % of the 700° F.+ (371° C.) fraction of the wax feed is achieved.

In the context of the invention, the terms "hydrogen" and "hydrogen treat gas" are synonymous and may be either pure hydrogen or a hydrogen-containing treat gas which is a treat gas stream containing hydrogen in an amount at least sufficient for the intended reactions, plus other gas or gasses (e.g., nitrogen and light hydrocarbons such as methane) which will not adversely interfere with or affect either the reactions or the products. The treat gas stream introduced into a reaction stage will preferably contain at least about 50 vol. %, more preferably at least about 80 vol. % hydrogen. In the integrated process embodiment the synthesis gas is produced from natural gas and contacted with a cobalt Fischer-Tropsch catalyst to produce the waxy hydrocarbons, which are dewaxed by the multi-stage hydrodewaxing process. It is not unusual for natural gas to comprise as much as 92+ mole % methane, with the remainder being primarily $C_{2+}$ hydrocarbons, nitrogen and $CO_2$. Thus, it is an ideal and relatively clean fuel for synthesis gas production. The methane has a 2:1$H_2$:C ratio and is ideal for producing a synthesis gas having an $H_2$:CO mole ratio of nominally 2.1:1 by a combination of partial oxidation and steam reforming. This is the stoichiometric mole ratio used with a non-shifting cobalt catalyst for hydrocarbon synthesis. Thus, natural gas is ideal for producing synthesis gas having the desired stoichiometric 2.1:1$H_2$:C mole ratio required when using a cobalt Fischer-Tropsch hydrocarbon synthesis catalyst and preferably one that is non-shifting. In producing synthesis gas from natural gas, sulfur and heteroatom compounds are removed from the natural gas, and in some cases also nitrogen and $CO_2$. The remaining methane-rich gas, along with oxygen or air and steam, is passed into a synthesis gas generator. Oxygen is preferred to air, because it doesn't introduce nitrogen into the synthesis gas generator (reactor). During the synthesis gas reaction, nitrogen present forms HCN and $NH_3$, both of which are poisons to a cobalt Fischer-Tropsch catalyst and must therefore be removed down to levels below 1 ppm. If nitrogen is not removed from the natural gas, and/or if air is used as the source of oxygen, before converting it into synthesis gas, HCN and $NH_3$ must be removed from the synthesis gas, before it is passed into the one or more hydrocarbon synthesis reactors. In a synthesis gas generator, the natural gas reacts with oxygen and/or steam to form synthesis gas, which then serves as the feed for the hydrocarbon synthesis. Known processes for synthesis gas production include partial oxidation, catalytic steam reforming, water gas shift reaction and combinations thereof. These processes include gas phase partial oxidation (GPOX), autothermal reforming (ATR), fluid bed synthesis gas generation (FBSG), partial oxidation (POX), catalytic partial oxidation (CPO), and steam reforming. ATR and FBSG employ oxygen and form the synthesis gas by partial oxidation and catalytic steam reforming. ATR and FBSG are preferred for producing synthesis gas in the practice of the invention. A review of these processes and their relative merits may be found, for example, in U.S. Pat. No. 5,883,138.

The invention will be further understood with reference to the example below.

EXAMPLE

The Fischer-Tropsch wax used as a feed for the hydrodewaxing process of the invention comprised a 430° F.+ (221° C.) waxy hydrocarbon fraction produced in a slurry Fischer-Tropsch reactor, in which the $H_2$ and CO were reacted in the presence of a titania supported cobalt rhenium catalyst to form hydrocarbons, most of which were liquid at the reaction conditions. The synthesis reactor was operating at conditions to produce to produce at least 14 pounds of 700° F.+ (371° C.+) hydrocarbons per 100 pounds of CO converted to hydrocarbons. This 430° F.+ (221° C.) wax comprised mostly normal paraffins, including 71.5 wt % of 700° F.+ (371° C.) hydrocarbons and 26.2 wt % of 1000° F.+ (538° C.) hydrocarbons. This raw (untreated) wax boiled continuously up to its end point of greater than 1050° F.+ (566° C.) and was fed directly into the first reactor, without any treatment. Three hydrodewaxing stages were used. Each of the three stages was an isothermal, up-flow, fixed bed reactor (R1, R2 and R3) and each contained the same hydrodewaxing catalyst. The relative amount of catalyst in the three reactors R1, R2 and R3, was 4500, 270 and 71, respectively. A ZSM-48 catalyst was used for hydrodewaxing the waxy hydrocarbons in all three reactors. It comprised 0.6 wt % Pt as the hydrogenating component, on a composite of the hydrogen form of the ZSM-48 zeolite and an alumina binder. The hydrogen form ZSM-48 zeolite component of the catalyst was prepared according to the procedure in U.S. Pat. No. 5,075,269, the disclosure of which is incorporated herein by reference. The Pt component was added by impregnation, followed by calcining and reduction, using known procedures.

Gas chromatograph distillations (GCD) were conducted using a high temperature GCD method modification of ASTM D-5307. The column consisted of a single capillary column with a thin liquid phase, less than 0.2 microns. External standards were used, consisting of a boiling point calibrant ranging from 5 to 100 carbons. A temperature programmed injector was used and, prior to injection, the samples were gently warmed using hot water. Boiling ranges were estimated using the T5 and T95 determined by the GCD results. Cloud point values were measured using ASTM D-5773 for Phase Tec Instruments under the lubricant procedure method. Pour point was measured according to ASTM D-5950 for ISL Auto Pour Point measurement. Viscosity and viscosity index were measured according to the ASTM protocol D-445 and D-2270, respectively. Noack volatility was measured according to ASTM D-5800, with a non-woods metal bath.

The raw wax and hydrogen were fed into the first reactor (R1), which produced an isomerate effluent comprising a dewaxed diesel fraction, having a cloud point of about −15° C., and a partially hydrodewaxed lubricant oil fraction. This first stage effluent was fractionated by atmospheric distillation, to separate the 700° F.− middle distillate fuel fraction, from the 700° F.+ (371° C.+) lubricant fraction. The 700° F.+ (371° C.+) fraction was fractionated by vacuum fractionation to produce a 700/950° F. (371/510° C.) and a 950° F.+ (510° C.+) fraction, which respectively comprised the lower boiling and heavy lubricant oil fractions. The lower boiling fraction and hydrogen were then passed into the second reactor (R2) to produce a hydrodewaxed effluent, which comprised a 700° F.+ (371° C.+) lubricant base stock fraction, having a pour point of about −23° C. The 950° F.+ (371° C.+) fraction and hydrogen were fed into the third reactor (R3), to produce an isomerate effluent comprising a dewaxed, heavy lubricant base stock fraction, having a cloud point of about 7° C. The overall conversion of 700° F.+ (371° C.+) hydrocarbons to 700° F.− (371° C.−) hydrocarbons, resulting from the three stage process, was only 27 wt % of the raw wax feed. This means that the 700° F.+ (371° C.+) selectivity of the process was 73%. The R2 and R3 reactor products were blended and distilled by a sequence of atmospheric and vacuum distillation into light (~4 cSt), medium (~6 cSt) and heavy (~16 cSt) lubricant base stocks. The reaction conditions and base stock properties are listed in Tables 1 and 2 below. The right hand column in Table 2 lists the properties for the combined 700° F.+ (371° C.+) lubricant base stock fractions, produced by the second and third reactors.

TABLE 1

| Reactor | Temperature ° F. (° C.) | Pressure psig/kPa | LHSV | Hydrogen Rate SCF/B |
|---|---|---|---|---|
| R1 | 586 (308) | 250/1724 | 1.0 | 2500 |
| R2 | 597 (314) | 245/1689 | 1.0 | 2500 |
| R3 | 616 (324) | 251/1731 | 1.0 | 2500 |

TABLE 2

| Property | 725/845° F. 385/452° C. | 845/1000° F. 453/538° C. | 1000° F.+ | R2 and R3 700° F.+ (371° C.+) |
|---|---|---|---|---|
| KV @ 100, cSt | 3.8 | 5.8 | 16.0 | 6.5 |
| VI | 140 | 157 | 156 | 163 |
| Pour Point, ° C. | −30 | −21 | −26 | −34 |
| Cloud Point, ° C. | −8.6 | −7.6 | 6.8 | −3.1 |
| Noack, vol % | 13.6 | 5.0 | 0.4 | |

What is claimed is:

1. A process for producing fuels and lubricant base stocks, including a heavy lubricant base stock, from Fischer-Tropsch wax comprising hydrocarbon fractions boiling in the fuel and lubricant boiling ranges, said process comprising (i) hydrodewaxing said wax to produce an isomerate comprising hydrodewaxed fuel and a partially hydrodewaxed lubricant fraction, (ii) separating these two fractions, (iii) separating said partially hydrodewaxed lubricant oil fraction into a heavy fraction and a lower boiling fraction, and (iv) separately further hydrodewaxing said lower boiling and heavy fractions, to produce lubricant base stocks, including a heavy lubricant base stock.

2. A process according to claim 1 wherein said hydrodewaxed fuel and said heavy and lower boiling base stocks each have cloud and pour points lower than that of their respective fractions in said wax.

3. A process according to claim 2 wherein said hydrodewaxing is achieved by separately contacting said wax and each of said partially dewaxed lubricant fractions with hydrogen, in the presence of a hydrodewaxing catalyst at hydrodewaxing conditions.

4. A process according to claim 3 wherein said heavy lubricant base stock has an initial boiling point of between 950–1,000° F.

5. A process according to claim 4 wherein said wax and each of said partially dewaxed lower boiling and heavy lubricant fractions are hydrodewaxed in separate hydrodewaxing stages.

6. A process according to claim 5 wherein said lubricant base stock has been hydrofinished and optionally dehazed.

7. A process according to claim 6 wherein said lubricant base stock is combined with one or more lubricant additives to form a lubricant.

8. A process according to claim 7 wherein said hydrodewaxing catalyst comprises a hydrogenating component, a binder and a solid acid component.

9. The process of claim 8 wherein said solid acid component is selected from the group consisting of ZSM-23, ZSM-35, ZSM-48, ZSM-57, ZSM-22, zeolite beta, mordinite, rare earth, ioin exchanged ferrerite, alumina, amorphous silica and mixtures thereof.

10. The process of claim 9 wherein said hydrogenation component comprises at least one Group VIII metal component.

11. The process of claim 10 wherein said binder is selected from the group consisting of zeolites, clays, silica, alumina, metal oxides, silica-alumina, silica-magnesia, silica-zirconia, silica-thoria, silica-beryllia, silica-titania, silica-alumina-thoria, silica-alumina, zirconia, silica-alumina-magnesia, silica-magnesia-zirconia and mixtures thereof.

12. A process according to claim 10 wherein said hydrodewaxing catalyst used to further dewax said partially dewaxed lower boiling lubricant fraction, to produce said lower boiling lubricant base stock, comprises a ZSM-48 zeolite solid acid component.

13. A process according to claim 10 wherein said hydrogenating component comprises a noble metal.

14. A process according to claim 12 wherein said hydrodewaxing catalyst used to hydrodewax said partially dewaxed heavy lubricant fraction comprises a ZSM-48 zeolite solid acid component and a nobel metal hydrogenating component.

15. A process comprising (a) producing synthesis gas comprising a mixture of $H_2$ and CO from natural gas, (b) contacting said synthesis gas with a cobalt Fischer-Tropsch hydrocarbon synthesis catalyst at reaction conditions effective for said $H_2$ and CO to react and form waxy hydrocarbons, including hydrocarbons boiling in the fuel and lubricant oil ranges, including a heavy lubricant oil range, (c) passing at least a portion of said waxy hydrocarbons to a hydrodewaxing upgrading facility in which said waxy hydrocarbons are (i) hydrodewaxed in the presence of a hydrodewaxing catalyst and hydrogen in a first hydrodewaxing stage to produce an isomerate comprising hydrodewaxed fuel and a partially hydrodewaxed lubricant fraction, (ii) separating these two fractions, (iii) separating said partially hydrodewaxed lubricant oil fraction into a heavy fraction and a lower boiling fraction, and (iv) separately further hydrodewaxing each of said lower boiling and heavy fractions in at least one separate respective lower boiling fraction hydrodewaxing stage and at least one separate respective heavy fraction hydrodewaxing stage, to produce lubricant base stocks, including a heavy lubricant base stock, and wherein a hydrodewaxing catalyst comprising a solid acid component, a hydrogenation component and a binder is used in at least one of said hydrodewaxing stages.

16. A process according to claim 15 wherein said waxy hydrocarbons formed in (b) are not hydroprocessed prior to being passed to said hydrodewaxing upgrading facility.

17. A process according to claim 16 wherein said dewaxed fuel and said heavy and lower boiling base stocks each have cloud and pour points lower than that of their respective fractions in said wax.

18. A process according to claim 17 wherein said heavy lubricant base stock has an initial boiling point of between 850–1,000° F.

19. A process according to claim 18 wherein said lower boiling and heavy lubricant base stocks each have cloud and pour points lower than that of their respective partially dewaxed factions.

20. A process according to claim 19 wherein at least one of said lubricant base stocks has been hydrofinished and optionally dehazed.

21. A process according to claim 20 wherein said at least one lubricant base stock is combined with one or more lubricant additives to form a lubricant.

22. The process of claim 21 wherein said solid acid component is selected from the group consisting of ZSM-22, ZSM-23, ZSM-35, ZSM-48, ZSM-57, SSZ-32, silica-alumina phosphates, zeolite beta, mordenite, rare earth on ion exchanged ferrierite, alumina, amorphous silica, and mixtures thereof.

23. The process of claim 21 wherein said hydrogenation component comprises at least one Group VIII metal component.

24. The process of claim 23 wherein said binder is selected from the group consisting of zeolites, clays, silica, alumina, metal oxides, silica-alumina, silica-magnesia, silica-zirconia, silica-thoria, silica boryllia, silica-titania, silica-alumina-thoria, silica-alumina-thoria, silica-alumina-zirconia, silica-alumina-magnesia, silica-magnesia-zirconia, and mixtures thereof.

25. The process of claim 24 wherein said solid acid component is ZSM-48 and said hydrogenation component is a Group VIII noble metal.

26. A process according to claim 25 wherein said hydrodewaxing catalyst comprising said ZSM-48 zeolite component and said noble metal hydrogenating component is used in at least one respective hydrodewaxing stage for separately hydrodewaxing each of said waxy hydrocarbons, said separated lower boiling isomerate lubricant fraction and said separated heavy isomerate lubricant fraction.

27. A process according to claim 26 wherein said hydrodewaxing catalyst comprising said ZSM-48 zeolite component and said noble metal hydrogenating component is used in at least two of said (i) said first hydrodewaxing stage, (ii) at least one hydrodewaxing stage in which said lower boiling fraction is further dewaxed and (iii) at least one hydrodewaxing stage in which said heavy fraction is further dewaxed.

28. A process comprising (a) producing synthesis gas comprising a mixture of $H_2$ and CO from natural gas, (b) contacting said synthesis gas with a non-shifting cobalt Fischer-Tropsch hydrocarbon synthesis catalyst at reaction conditions effective for said $H_2$ and CO to react and form waxy hydrocarbons, including hydrocarbons boiling in the fuel and lubricant oil boiling ranges, including a heavy lubricant oil, ranges (c) passing at least a portion of said waxy hydrocarbons to a hydrodewaxing upgrading facility in which said waxy hydrocarbons are (i) hydrodewaxed in the presence of a hydrodewaxing catalyst and hydrogen in a first hydrodewaxing stage to produce an isomerate comprising hydrodewaxed fuel and a partially hydrodewaxed lubricant fraction, (ii) separating these two fractions, (iii) separating said partially hydrodewaxed lubricant oil fraction into a heavy fraction and a lower boiling fraction, and (iv) separately further hydrodewaxing each of said lower boiling and heavy fractions in at least one separate respective lower boiling fraction hydrodewaxing stage and at least one separate respective heavy fraction hydrodewaxing stage, to produce lubricant base stocks, including a heavy lubricant base stock, and wherein a hydrodewaxing catalyst comprising a ZSM-48 zeolite component and a noble metal hydrogenating component is used in at least one of said hydrodewaxing stages to hydrodewax at least one of said waxy hydrocarbons.

29. A process according to claim 28 wherein said waxy hydrocarbons formed in (b) are not hydroprocessed prior to being passed to said hydrodewaxing upgrading facility.

30. A process according to claim 29 wherein said hydrodewaxing catalyst comprising a ZSM-48 zeolite component and a noble metal hydrogenating component is used to hydrodewax at least two of said waxy hydrocarbons.

* * * * *